US006938290B2

(12) United States Patent
McKinney et al.

(10) Patent No.: US 6,938,290 B2
(45) Date of Patent: Sep. 6, 2005

(54) SEAT CUSHION

(76) Inventors: Richard A. McKinney, 50 Goat Island Ct., Clarksville, VA (US) 23927; Barbara J. McKinney, 50 Goat Island Ct., Clarksvile, VA (US) 23927; David P. Colvin, 123 Harmony Hill La., Cary, NC (US) 27513

( * ) Notice: Subject to any disclaimer, the term of this patent is extended or adjusted under 35 U.S.C. 154(b) by 99 days.

(21) Appl. No.: 10/419,560

(22) Filed: Apr. 21, 2003

(65) Prior Publication Data

US 2003/0204913 A1 Nov. 6, 2003

Related U.S. Application Data

(60) Provisional application No. 60/377,417, filed on May 3, 2002.

(51) Int. Cl.[7] ..... A47C 20/02

(52) U.S. Cl. ..... 5/654; 5/652; 5/655.3; 297/452.27

(58) Field of Search ..... 5/652, 655.3, 655.5, 5/654, 727; 297/452.27

(56) References Cited

U.S. PATENT DOCUMENTS

| | | | | | |
|---|---|---|---|---|---|
| 3,833,259 | A | * | 9/1974 | Pershing | 297/452.27 |
| 4,627,179 | A | * | 12/1986 | McElroy | 36/44 |
| 4,682,818 | A | * | 7/1987 | Morell | 297/452.27 |
| 5,030,501 | A | * | 7/1991 | Colvin et al. | 428/178 |
| 5,518,802 | A | * | 5/1996 | Colvin et al. | 428/178 |
| 5,855,415 | A | * | 1/1999 | Lilley, Jr. | 297/452.27 |
| 6,625,830 | B2 | * | 9/2003 | Lampel | 5/653 |
| 2002/0067064 | A1 | * | 6/2002 | Jaillet et al. | 297/452.27 |

* cited by examiner

*Primary Examiner*—Teri Pham Luu
(74) *Attorney, Agent, or Firm*—Robert G. Rosenthal

(57) ABSTRACT

Impact energy forces to the spine are reduced through the use of multiple overlying pliable impact energy absorbing layers. Each layer comprises a plurality of cells that are in fluid communication which provides for a valved transfer of fluid between the cells. Additionally, each layer has a different durometer.

19 Claims, 4 Drawing Sheets

SEAT CUSHION

PRIOR APPLICATION

This application claims the benefit of U.S. Provisional Patent Application Ser. No. 60/377,417 filed May 3, 2002.

GOVERNMENT RIGHTS

This invention was developed under Naval Air Systems Command Contract No. N00019-96-C-0043. The United States government may have certain rights in this invention.

FIELD OF THE INVENTION

This invention relates generally to the field of cushioning structures and more particularly seat cushions that offer the user protection from potentially injurious impacts.

BACKGROUND OF THE INVENTION

It is well known that injuries sustained in aircraft crashes or so-called "hard landings" can result in serious injury and/or death to the occupants. For example, when an aircraft such as a helicopter experiences power reduction and/or loss and lands, significant forces are transmitted to the passengers and crew. Research has shown that spinal injuries can be expected when forces exceed 9.5 Gs which results in 2500 lbs of spinal loading. In addition, to injuries sustained in aircraft, spinal injuries can occur in vehicles when the ride is bumpy such as motor/speed boats, race cars, all-terrain vehicles, military ground vehicles (humvees and tanks), farm and construction equipment as well as gravitationally based amusement park rides. The foregoing spinal injuries can collectively be referred to as "impact injuries". Proper seat design can help protect the occupants by attenuating impact acceleration thereby decreasing the injury producing forces. One way to achieve this goal is to extend the duration of the impact pulse, thus reducing the peak acceleration to safe levels.

When the spine suffers an impact injury, the injured party may become permanently or temporarily disabled to varying degrees, but the economic losses to the employer can also be great. For example, a helicopter or jet pilot represents a multi-million dollar investment when all of the training costs and experience are considered. In response to the foregoing, some attempts have been made to improve existing seating. These systems rely on foams and crushable materials for comfort, but provide only a minimum level of protection from impact energy. Even the advanced foams utilize the foam properties as the only means of protecting the occupant. These advanced foams are expensive and provide only a minor improvement in energy dissipation and, in fact, studies have shown that when foam cushioning "bottoms out" the body is exposed to dynamic overshoot and the potential for spinal injury actually increases. In view of the foregoing, it would be of great commercial value to provide a means of reducing impact injuries to the spine.

It is accordingly an object of the present invention to provide cushioning device that overcomes the above noted problems associated with the prior art devices.

Another object of the present invention is to provide a cushioning device that minimizes impact injuries by dissipating impact energy before it is transmitted to the human body.

A further object of the present invention is to provide a cushioning device that improves the survival rate of persons involved in aircraft crashes.

Still another object of the present invention is to provide a cushioning device that is re-useable.

Yet another object of the present invention is to provide a cushioning device that reduces loading on the spine.

A still further object of the present invention is to provide a cushioning device that is relatively inexpensive and easy to install.

A related object of the present invention is to provide a cushioning device that does not bottom out upon impact.

SUMMARY OF THE INVENTION

In accordance with the present invention, there is provided a cushioning device adapted to support a load and to reduce damage to the load as the result of externally applied impact forces. The apparatus comprises a first impact energy absorbing layer adapted to be placed beneath the load and to spread the impact energy substantially in the plane of the impact energy absorbing layer. The impact energy absorbing layer comprises a plurality of cells of pliable material having a first durometer, the cells being in fluid communication with each other to provide a valved fluid transfer between cells.

A second impact energy absorbing layer is positioned beneath the first impact energy absorbing layer and is adapted to spread the impact energy substantially in the plane of the second impact energy absorbing layer. Further, the second impact energy absorbing layer comprises a plurality of cells of pliable material, the cells are in fluid communication with each other to provide a valved fluid transfer between cells. The second impact energy absorbing layer differs structurally from the first impact energy absorbing layer. The structural difference is selected from one or more characteristics selected from the group consisting of durometer, fluid communication, impact energy absorbing layer thickness, cell shape and cell size.

A third impact energy absorbing layer may be positioned beneath the second impact energy absorbing layer and is adapted to spread the impact energy substantially in the plane of the third impact energy absorbing layer. The third impact energy absorbing layer comprises a plurality of cells of pliable material, the cells being in fluid communication with each other to provide a valved fluid transfer between cells. The second impact energy absorbing layer differs structurally from the first impact energy absorbing layer. The structural difference is selected from one or more characteristics selected from the group consisting of durometer, fluid communication, impact energy absorbing layer thickness, cell shape and cell size. As a result, the cushioning device absorbs impact energy force thereby reducing or eliminating damage to the supported load.

In the preferred embodiment, the respective impact energy absorbing layers are substantially identical, except that the durometer of the third impact energy absorbing layer is less than the durometer of the second impact energy absorbing layer which is less than the durometer of the first impact energy absorbing layer.

BRIEF DESCRIPTION OF THE DRAWINGS

Some of the objects of the invention having been stated, other objects will appear as the description proceeds when taken in connection with the accompanying drawings in which.

DETAILED DESCRIPTION OF THE PREFERRED EMBODIMENTS

While the present invention will be described more fully hereinafter, it is to be understood at the outset that persons of skill in the art may modify the invention herein described while still achieving the favorable results of this invention.

Figure 1:
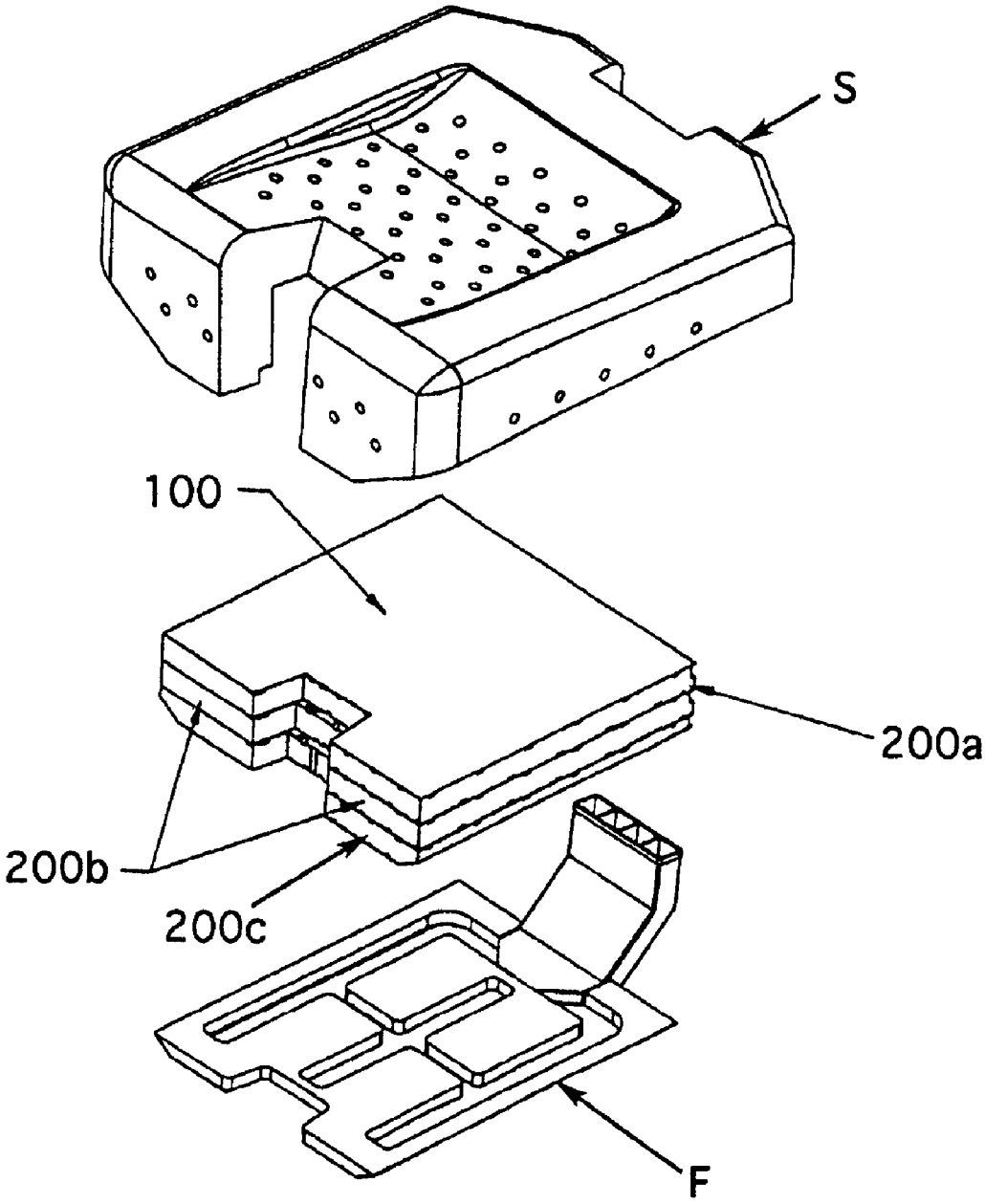
FIG. 1 is an exploded view of a seat containing the cushioning structure according to the present invention.

Referring now to the drawings and specifically to FIG. 1, illustrated therein is a typical seat S which has positioned therein the cushioning material according to the present invention, generally indicated at 100, positioned therein. As will be more fully explained hereinbelow, the cushioning material comprises preferably three overlying impact energy absorbing layers 200*a*, 200*b* and 200*c*, each of which is essentially identical, except that each has a different durometer. With reference to the description that follows, the impact energy absorbing layers are generically referred to as layer 200. The seat S and the impact energy absorbing layer(s) are attached to a frame F by conventional mean, well known to those skilled in the art.

Figure 3:
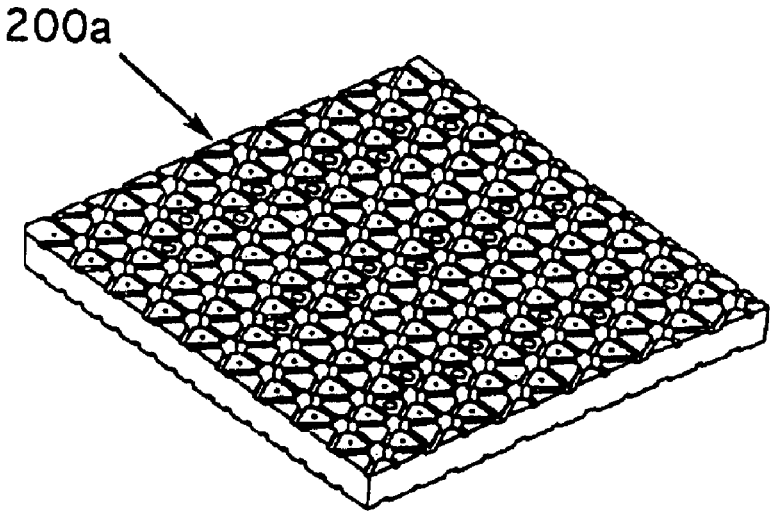
FIG. 3 is a perspective view of a portion of one impact energy absorbing layer of the cushioning structure according to the present invention.
Figure 4A:
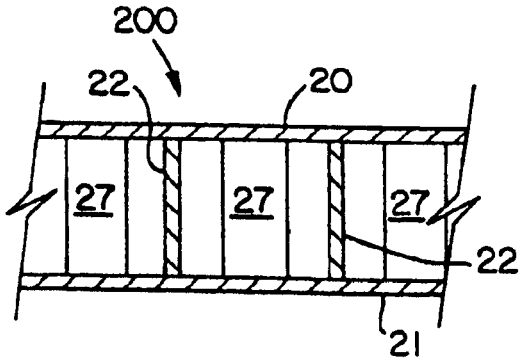
FIG. 4A is a partial elevational section view of one impact energy absorbing layer of the cushioning structure according to the present invention.
Figure 4B:
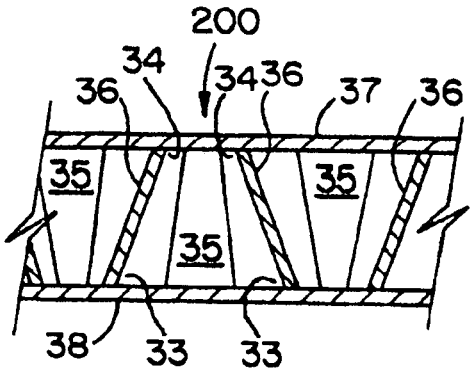
FIG. 4B is a partial elevational section view of another embodiment of one impact energy absorbing layer of the cushioning structure according to the present invention.

Turning now to the details of the impact energy absorbing layer 200, it is disclosed in U.S. Pat. Nos. 5,030,501 and 5,518,802 titled Cushioning Structure which are incorporated herein by reference. As best shown in FIGS. 2 through 4B, the impact energy absorbing layer comprises a plurality of cells 76 which are in fluid communication with each other to provide a valved fluid transfer between cells. As shown in FIGS. 3 and 4B, the cell members 35 are of hexagonal shape in cross-sectional plan. In the finally assembled condition, the sides of the individual hexagonal cells 35 are bonded to the top stratum 37 and bottom stratum 38 at edges 33 and 34 at one side and at edges 36 at the opposite side, respectively. The bond formed at the edges 36 and 33, 34 is a substantially hermetically sealed connection so that in the assembled condition the matrix includes a plurality of generally hexagonal cells 35 separately sealed one from the next, except as specifically otherwise provided and as hereafter defined.

Since the materials are heat sealable the various seals described herein may be accomplished by conventional heat sealing means. Adhesive or other suitable means could also be used.

The layer 200 is hermetically closed at the periphery and an inlet (not shown) may be provided for the admission of a fluid such as air or other gas which may be at a pressure above surrounding atmosphere or environment in which the structure is placed. The layer 200 is constructed of generally pliable materials, usually plastics, including vinyl and/or polyethylene type films.

Dimensionally it is conceived that the layer 200 could be between about one (1) and thirty (30) centimeters "thick", i.e., the distance from the outside of one stratum to the other, depending upon application. The thickness of the sheet materials from which the strata 20 and 21 and matrix cells wall elements 22 are formed may be between about 0.01 and 100 mills.

Figure 2:
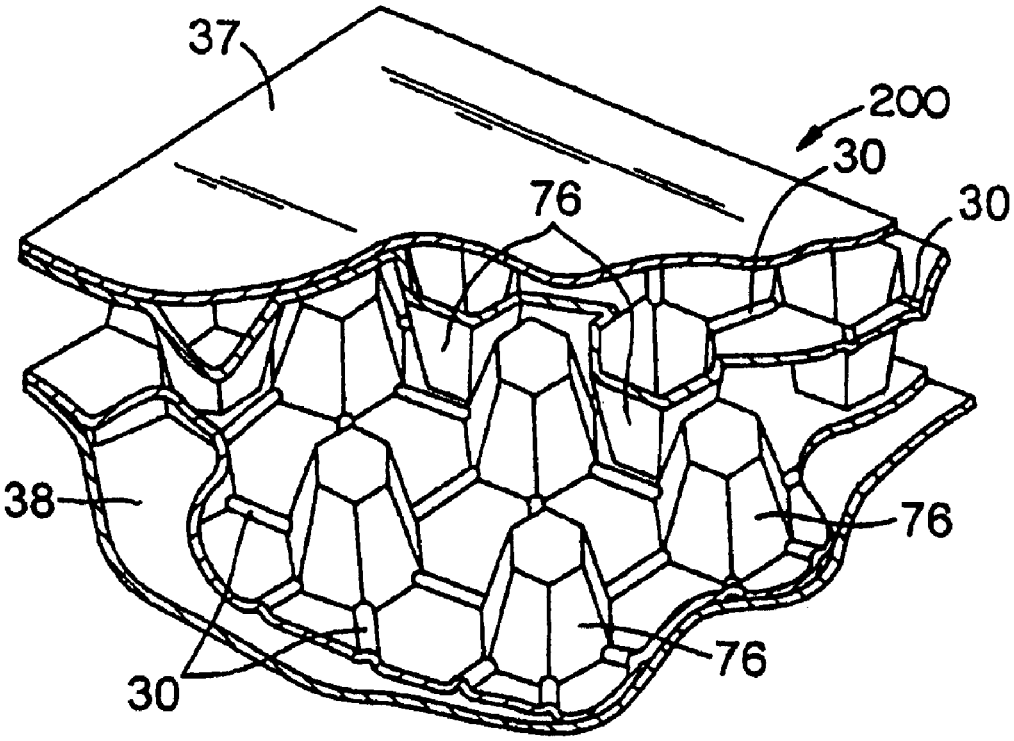
FIG. 2 is a partial schematic sectional view of a portion of one layer of the cushioning structure according to the present invention.

In the embodiment shown in FIGS. 2 and 4B the matrix cells comprise hexagonal polygons. Such shape has been chosen because of the unique form of hexagon that permits complete nesting of the vertical surfaces of the cell one to the next. Nevertheless, other forms of polygons may provide the advantages of this invention and are to be considered as within the concepts worthy of further evaluation and usefulness in the application of the principles that are embodied in the layer 200.

For instance, the contacting wall between polygons may be sloped rather than vertical providing tapered or truncated polygons, rather than rectangular polygons as shown in FIG. 2. In this embodiment a plurality of cells 35 have substantially upstanding sides 36 bonded to an upper planar sheet like stratum 37 and a similar lower stratum 38.

Still other forms of polygons are within ready conception, for instance, pentagons or cones.

Figure 5A:
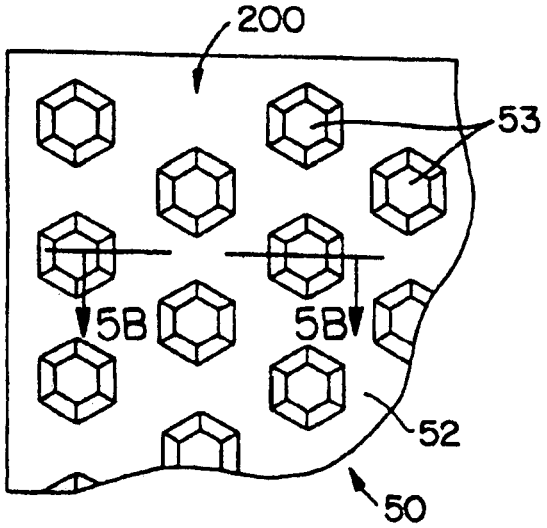
FIG. 5A is a partial plan view of another embodiment of the cushioning structure of this invention.
Figure 5B:
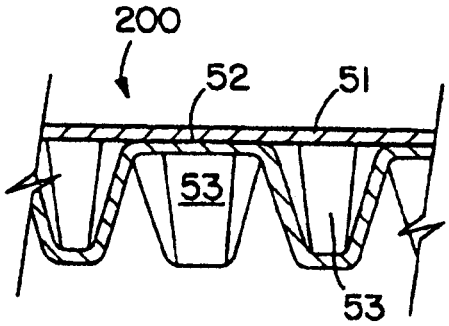
FIG. 5B is a partial elevational section taken on the line 5B—5B of FIG. 5A.

Referring to FIGS. 5A and 5B a structure 50 includes an upper stratum 51 to which is bonded a lower cellular matrix 52 on which is formed a plurality of downstanding/upstanding truncated polygon cells 53 selectively arranged in mutually supporting and equally load distributing relationship across the surface of the stratum 51.

Figure 6:
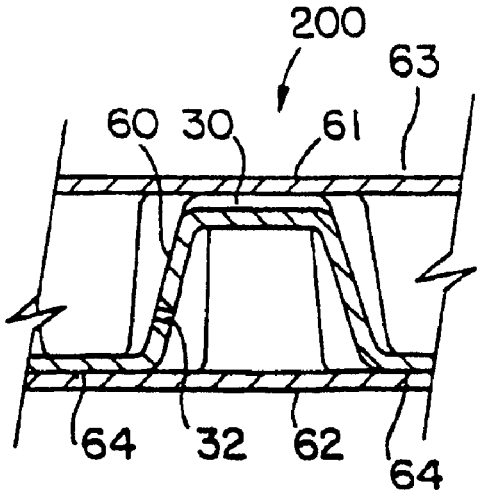
FIG. 6 is a sectional elevation view of another embodiment of the impact energy absorbing layer of this invention.

In another aspect of this invention as shown in FIG. 6, a passage way conduit or aperture 30 is provided from a polygon to each of the adjacent cells through which the fluid is conducted to pass from one cell to the next. By the proper selection of the size of such conduits, the rate of fluid flow may be controlled and serve to "valve" the rate of the fluid passage from one cell to the next. Thus, the impact energy absorbency of each layer may be engineered as needed for a particular application. Such conduits 30 may be provided by allowing unbonded areas between the end of a cell 60 and the stratum 61. This controlled venting of the compressed air acts as a spring within the impacted cell and serves to maximize the absorption of the impact energy while minimizing the energy available for rebound. The difference in pressure between the impacted and the unimpacted, adjacent cells aids the controlled reinflation of the impacted cell in order to provide protection from repeated impacts.

In the embodiment of FIG. 6, an internal matrix structure 60 is sandwiched between an upper stratum 61 and a lower stratum 62 and bonded there between at the surfaces 63 and 64.

Referring to FIG. 6, the internal matrix structure 61 is provided with substantially upstanding walls that may also be designed to provide a one-way valve-like aperture 32 between the walls of the two mating hexagonal structures that aids the reduction of rebound energy. The apertures 32 open upon an impact due to the columnar buckling of the cell walls and pass fluid from the impacted area to adjacent areas when the pressure on the one side increases to a valve higher than the pressure on the other side. When the pressure equalizes during the structural rebound, the resilience of the material in the member 61 causes the valved opening to close or partially close thereby restricting the reverse flow by allowing the pressure to gradually equalize.

In prototype that was tested, it was determined that the durometer of the first impact energy absorbing layer 200*a* (positioned closest to the load) should be greater than the durometer of the second impact energy absorbing layer 200*b* (the middle layer) which should be greater than the lowest impact energy absorbing layer 200*c*. Specifically, the durometers were selected as follows:

| Impact Energy Absorbing Layer | Durometer Range | Optimal Durometer |
|---|---|---|
| 200a | 45–55 | 50 |
| 200b | 37–47 | 42 |
| 200c | 25–35 | 30 |

Figure 7:
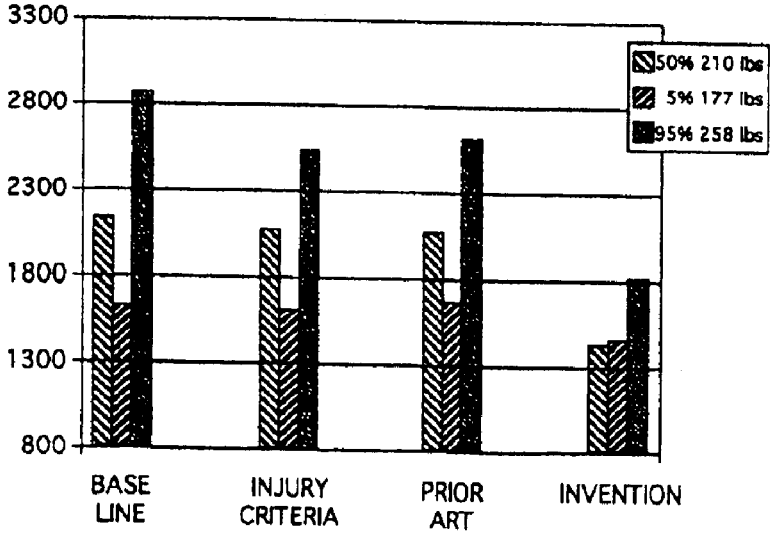
FIG. 7 is a bar chart illustrating the lumbar loading for a 23 g force pulse.

In tests that were conducted a 40% reduction in lumbar load was observed as compared with both the injury criteria and a competitive product as shown in FIG. 7. In the tests a test dummy as subjected to a lumbar load with a 23 g pulse and the loading was reduced from about 2600 pounds experienced by a competitive foam product to about 1800 pounds with the present invention, which is well below the injury criteria of 2500 pounds. The model that was constructed was for a specific application in an existing helicopter seat and only three inches of space was available to receive the cushioning device 200. It is believed that further reductions in impact force could be achieved were this not a retrofit application.

In view of the foregoing, it will be appreciated that for a specific application, the thickness, valve dimensions and durometer will have to engineered depending on the weight of the load and the type of impact forces expected.

Notwithstanding the foregoing, it will be recognized that the respective impact energy absorbing layers may be engineered for other applications. As such, the respective impact energy absorbing layers 200 may differ structurally from each other in a number of characteristics such as durometer (previously discussed), the fluid communication, impact energy absorbing layer thickness, cell shape and cell size. With respect to fluid communication, the diameter (or other characteristic) of the channels may be varied to obtain the desired degree of fluid transfer between cells.

When using the cushioning structure 200 to support a load or passenger, a first impact energy absorbing layer 200*a* is positioned beneath the load. The impact energy absorbing layer 200*a* is designed to spread the impact energy substantially in the plane of the impact energy absorbing layer 200*a*. The layer 200*a* is comprised of a plurality of cells of a pliable material and the cells 35 are in fluid communication with each other to provide a valved fluid transfer between cells 35 by means of channels 80.

A second impact energy absorbing layer 200*b* is positioned beneath the first impact energy absorbing layer 200*a* to spread the impact energy absorbing layer substantially in the plane of the second impact energy absorbing layer. The second impact energy absorbing layer 200*b* comprises a plurality of cells 35 of pliable material and the cells are in fluid communication with each other to provide a valved transfer between cells. The first layer 200*a* differs structurally from the second layer 200*b*. The structural difference between the respective layers 200*a*, 200*b* is selected from the group consisting of durometer, fluid communication, impact energy absorbing layer thickness, cell shape and cell size, depending on application.

In addition, a third impact energy absorbing layer 200*c* is positioned beneath the second impact energy absorbing layer 200*b* to spread the impact energy absorbing layer substantially in the plane of the second impact energy absorbing layer. The second impact energy absorbing layer 200*b* comprises a plurality of cells 35 of pliable material and the cells are in fluid communication with each other to provide a valved transfer between cells. The second layer 200*b* differs structurally from the third layer 200*c*. The structural difference between the respective layers 200*a*, 200*b* is selected from the group consisting of durometer, fluid communication, impact energy absorbing layer thickness, cell shape and cell size, depending on application.

In the illustrated embodiment, the respective layers differed from each other in durometer, the successively lower layers having lower a lower durometer.

While the embodiments of the invention shown and described is fully capable of achieving the results desired, it is to be understood that these embodiments have been shown and described for purposes of illustration only and not for purposes of limitation. Other variations in the form and details that occur to those skilled in the art and which are within the spirit and scope of the invention are not specifically addressed. Therefore, the invention is limited only by the appended claims.

That which is claimed is:

1. A cushioning device adapted to support a load and to reduce damage to the load as the result of externally applied impact forces and comprising:

a first impact energy absorbing layer adapted to be placed beneath the load and to spread the impact energy substantially in the plane of the impact energy absorbing layer, and wherein said impact energy absorbing layer comprises a plurality of cells of pliable material, the cells being in fluid communication with each other to provide a valved fluid transfer between cells, said first impact energy absorbing layer being hermetically closed at its periphery and being maintained at a pressure above the surrounding atmosphere; and a second impact energy absorbing layer positioned beneath the first impact energy absorbing layer and being adapted to spread the impact energy substantially in the plane of the second impact energy absorbing layer, and wherein said second impact energy absorbing layer comprises a plurality of cells of pliable material, said cells being in fluid communication with each other to provide a valved fluid transfer between cells, said second impact energy absorbing layer being hermetically closed at its periphery and being maintained at a pressure above the surrounding atmosphere and wherein said second impact energy absorbing layer differs structurally from said first impact energy absorbing layer, said structural difference being one or more characteristics selected from the group consisting of durometer, fluid communication, impact energy absorbing layer thickness, cell shape, and cell size;

whereby the cushioning device absorbs impact energy force thereby reducing or eliminating damage to the supported load.

2. The cushioning structure according to claim 1 further including a third impact energy absorbing layer positioned beneath the second impact energy absorbing layer and being adapted to spread the impact energy substantially in the plane of the third impact energy absorbing layer, and wherein said third impact energy absorbing layer comprises a plurality of cells of pliable material having said cells being in fluid communication with each other to provide a valved fluid transfer between cells, said third impact energy absorbing layer being hermetically closed as its periphery and being maintained at a pressure above the surrounding atmosphere and wherein said third impact energy absorbing layer differs structurally from said respective first and second impact energy absorbing layers, said structural difference being one or more characteristics selected from the group consisting of durometer, fluid communication, impact energy absorbing layer thickness, cell shape, and cell size.

3. The cushioning structure according to claim 2 wherein the second impact energy absorbing layer has a durometer which is less than the durometer of the first impact energy absorbing layer.

4. The cushioning structure according to claim 3 wherein the third impact energy absorbing layer has a durometer that is less than the durometer of the second impact energy absorbing layer.

5. The cushioning structure according to claim 2 wherein the durometer of the first impact energy absorbing layer is between about 48 and 52, the durometer of the second impact energy absorbing layer is between about 40 and 44 and the durometer of the third impact energy absorbing layer is between about 28 and 32.

6. The cushioning structure according to claim 2 wherein the durometer of the first impact energy absorbing layer is between about 45 and 55, the durometer of the second impact energy absorbing layer is between about 37–47 and the durometer of the third impact energy absorbing layer is between about 25 and 35.

7. The cushioning structure according to claim 1 wherein the first impact energy absorbing layer is adapted to be positioned beneath the load.

8. A method of supporting a load and to reduce damage to the load as the result of externally applied impact forces and comprising the steps of:

positioning a first impact energy absorbing layer beneath the load to spread the impact energy substantially in the plane of the impact energy absorbing layer, and wherein the impact energy absorbing layer comprises a plurality of cells of pliable material,the cells being in fluid communication with each other to provide a valved fluid transfer between cells, the first impact energy absorbing layer being hermetically closed at its periphery and being maintained at a pressure above the surrounding atmosphere; and positioning a second impact energy absorbing layer beneath the first impact energy absorbing layer to spread the impact energy substantially in the plane of the second impact energy absorbing layer, and wherein the second impact energy absorbing layer comprises a plurality of cells of pliable material, said cells being in fluid communication with each other to provide a valved fluid transfer between cells, the second impact energy absorbing layer being hermetically closed at its periphery and being maintained at a pressure above the surrounding atmosphere and wherein the second impact energy absorbing layer differs structurally from the first impact energy absorbing layer, the structural difference being one or more characteristics selected from the group consisting of durometer, fluid communication, impact energy absorbing layer thickness, cell shape, and cell size;

whereby the cushioning device absorbs impact energy force thereby reducing or eliminating damage to the supported load.

9. The method according to claim 8 further including the step of positioning a third impact energy absorbing layer beneath the second impact energy absorbing layer and being adapted to spread the impact energy substantially in the plane of the third impact energy absorbing layer, and wherein the third impact energy absorbing layer comprises a plurality of cells of pliable material having the cells being in fluid communication with each other to provide a valved fluid transfer between cells, the third impact energy absorbing layer being hermetically closed at its periphery and being maintained at a pressure above the surrounding atmosphere and wherein the third impact energy absorbing layer differs structurally from said respective first and second impact energy absorbing layers, the structural difference being one or more characteristics selected from the group consisting of durometer, fluid communication, impact energy absorbing layer thickness, cell shape, and cell size.

10. The cushioning structure according to claim 9 wherein the durometer of the first impact energy absorbing layer is between about 48 and 52, the durometer of the second impact energy absorbing layer is between about 40 and 44 and the durometer of the third impact energy absorbing layer is between about 28 and 32.

11. The method according to claim 9 wherein the third impact energy absorbing layer has a durometer that is less than the durometer of the second impact energy absorbing layer.

12. The cushioning structure according to claim 9 wherein the durometer of the first impact energy absorbing layer is between about 45 and 55, the durometer of the second impact energy absorbing layer is between about 37–47 and the durometer of the third impact energy absorbing layer is between about 25 and 35.

13. The method according to claim 8 wherein the second impact energy absorbing layer has a durometer which is less than the durometer of the first impact energy absorbing layer.

14. A seat cushion adapted to be attached to a vehicle and to support an occupant therein, the seat providing the occupant with protection from injury caused by impulse-type forces and comprising, in combination:

a first impact energy absorbing layer adapted to be placed beneath the load and to spread the impact energy substantially in the plane of the impact energy absorbing layer, and wherein said impact energy absorbing layer comprises a plurality of cells of pliable material, the cells being in fluid communication with each other to provide a valved fluid transfer between cells, said first impact energy absorbing layer being hermetically closed at its periphery and being maintained at a pressure above the surrounding atmosphere;

a second impact energy absorbing layer positioned beneath the first impact energy absorbing layer and being adapted to spread the impact energy substantially in the plane of the second impact energy absorbing layer, and wherein said second impact energy absorbing layer comprises a plurality of cells of pliable material, said cells being in fluid communication with each other to provide a valved fluid transfer between cells, said second impact energy absorbing layer being hermetically closed at its periphery and being maintained at a pressure above the surrounding atmosphere and wherein said second impact energy absorbing layer differs structurally from said first impact energy absorbing layer, said structural difference being one or more characteristics selected from the group consisting of durometer, fluid communication, impact energy absorbing layer thickness, cell shape, and cell size; and a seat frame adapted to be attached to the respective first and second impact energy absorbing layers, whereby the cushioning device absorbs impact energy force thereby reducing or eliminating damage to the supported load.

15. The seat according to claim 14 further including a third impact energy absorbing layer positioned beneath the second impact energy absorbing layer and being adapted to spread the impact energy substantially in the plane of the third impact energy absorbing layer, and wherein said third impact energy absorbing layer comprises a plurality of cells of pliable material having said cells being in fluid communication with each other to provide a valved fluid transfer between cells, said third impact energy absorbing layer being hermetically closed at its periphery and being maintained at a pressure above the surrounding atmosphere and wherein said third impact energy absorbing layer differs structurally from said respective first and second impact energy absorbing layers, said structural difference being one or more characteristics selected from the group consisting of durometer, fluid communication, impact energy absorbing layer thickness, cell shape, and cell size.

16. The cushioning structure according to claim 15 wherein the durometer of the first impact energy absorbing layer is between about 45 and 55, the durometer of the second impact energy absorbing layer is between about 37–47 and the durometer of the third impact energy absorbing layer is between about 25 and 35.

17. The cushioning structure according to claim 15 wherein the third impact energy absorbing layer has a durometer that is less than the durometer of the second impact energy absorbing layer.

18. The seat according to claim 14 wherein the second impact energy absorbing layer has a durometer which is less than the durometer of the first impact energy absorbing layer.

19. The cushioning structure according to claim 18 wherein the durometer of the first impact energy absorbing layer is between about 48 and 52, the durometer of the second impact energy absorbing layer is between about 40 and 44 and the durometer of the third impact energy absorbing layer is between about 28 and 32.

* * * * *